US006584713B2

(12) United States Patent
Huang

(10) Patent No.: US 6,584,713 B2
(45) Date of Patent: Jul. 1, 2003

(54) DECORATIVE LAMP SIMULATING THE EFFECT OF AN AQUARIUM

(76) Inventor: Line-Yao Huang, No. 41, Lane 343, Luho Rd., Sec. 5, Homei Town, Changhua County (TW)

( * ) Notice: Subject to any disclaimer, the term of this patent is extended or adjusted under 35 U.S.C. 154(b) by 0 days.

(21) Appl. No.: 09/840,163

(22) Filed: Apr. 24, 2001

(65) Prior Publication Data

US 2002/0152656 A1 Oct. 24, 2002

(51) Int. Cl.[7] ..... G09F 13/00
(52) U.S. Cl. ..... 40/431; 362/811; 40/554
(58) Field of Search ..... 40/431, 738, 743, 40/473, 554, 572, 577; 362/811

(56) References Cited

U.S. PATENT DOCUMENTS 5,065,289 A * 11/1991 Teng ..... 362/101
5,685,097 A * 11/1997 Marinov ..... 40/431
2002/0105808 A1 * 8/2002 Ting ..... 362/281

* cited by examiner

*Primary Examiner*—William L Miller
(74) *Attorney, Agent, or Firm*—Rosenberg, Klein & Lee

(57) ABSTRACT

A decorative lamp includes a base holding a lamp bulb and a motor drive unit, a rotary table supported on the base around the lamp bulb and rotated by the motor drive unit, an inner lampshade fixedly mounted on the rotary table for synchronous rotation with the rotary table, the inner lamp shade having a design of underwater scene on an outside wall thereof, and a magnifying transparent outer lampshade fixedly mounted on the base and covering over the inner lampshade to magnify the dimensions of the inner lampshade.

1 Claim, 4 Drawing Sheets

DECORATIVE LAMP SIMULATING THE EFFECT OF AN AQUARIUM

BACKGROUND OF THE INVENTION

The present invention relates to a lamp and, more particularly, to a decorative lamp, which simulates the effect of an aquarium.

An aquarium-simulating lamp is shown, as shown in FIGS. 1 and 2, comprised of a base 10, a rotary table 16, an inner lamp shade 19, an intermediate lamp shade 20, and an outer transparent lamp shade 22. The base 10 comprises a top coupling groove 101. A motor (not shown) is mounted inside the base 10. A lamp bulb 11 is provided at the top side of the base 10. A pinion 12 is fixedly mounted on the output shaft M of the motor and disposed above the top sidewall of the base 10. Transmission gears 13, 14, 15 are provided in the base 10 and meshed with one another and driven to rotate by the pinion 12. The inner lamp shade 19 admits light, having a design of water animals, water waves, and spindrift on the outside wall thereof and a bottom coupling groove 190. The rotary table 16 is fixedly mounted in the bottom coupling groove 190 of the inner lamp shade 19 and revolvably secured to the base 10 with a locating ring 18 by screws, comprising a plurality of hooks 160, and a driven gear 17 meshed with the transmission gear 14. When starting the motor, the inner lamp shade 19 is rotated with the rotary table 16 in clockwise direction on the base 10. The intermediate lamp shade 20 admits light and is mounted on the base 10 around the inner lamp shade 19, having a design of underwater scene on the outside wall thereof and a bottom inner gear 21 meshed with the transmission gear 13 for counter-clockwise rotation on the base 10 relative to the inner lamp shade 19. The transparent outer lamp shade 22 is fastened to the base 10 and covered over the intermediate lamp shade 20 and the inner lamp shade 19, having a plurality of bottom hooks 220 respectively hooked on the top coupling groove 101 of the base 10. When starting the motor, the inner lamp shade 19 and the outer lamp shade 20 are rotated relative to each other in reversed directions, to show a motion, simulating the effect of an aquarium. This structure of aquarium-simulating lamp has numerous drawbacks as outlined hereinafter:

1. The transparent outer lampshade 22 is a simple covering that does not enlarge the image of the inner lampshade 19 and the outer lampshade 20 to produce a three-dimensional visual effect.
2. Because two rotary lampshades (the inner lampshade and the intermediate lampshade) are provided, the structure of the aquarium-simulating lamp is complicated, and much electric energy is consumed when rotating the two rotary lampshades in the reversed directions.
3. Because the aquarium-simulating lamp does not have image enlarging function, it is less attractive.

SUMMARY OF THE INVENTION

It is one object of the present invention to provide a decorative lamp, which simulates the visual effect of an aquarium. It is another object of the present invention to provide an aquarium-simulating decorative lamp, which has a simple structure. It is still another object of the present invention to provide an aquarium-simulating decorative lamp, which provides a magnified motion visual effect. According to one aspect of the present invention, the decorative lamp comprises a base holding a lamp bulb and a motor drive unit, a rotary table supported on the base around the lamp bulb and rotated by the motor drive unit, an inner lampshade fixedly mounted on the rotary table for synchronous rotation with the rotary table, the inner lamp shade having a design of underwater scene on its outside wall, and a transparent outer lampshade fixedly mounted on the base and covering over the inner lampshade, the transparent outer lampshade having a design of underwater scene on its inside wall. According to another aspect of the present invention, the transparent outer lampshade is a magnifying lampshade having ribs on its outside wall to function as convex lens means for magnifying the dimensions of the inner lampshade.

DETAILED DESCRIPTION OF THE PREFERRED EMBODIMENT

Figure 1A:
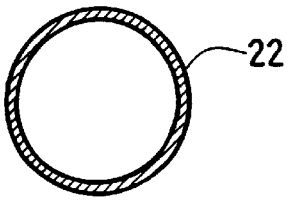
FIG.1A PRIOR ART
FIG. 1A is a sectional view taken along line A—A of FIG. 1.
Figure 1:
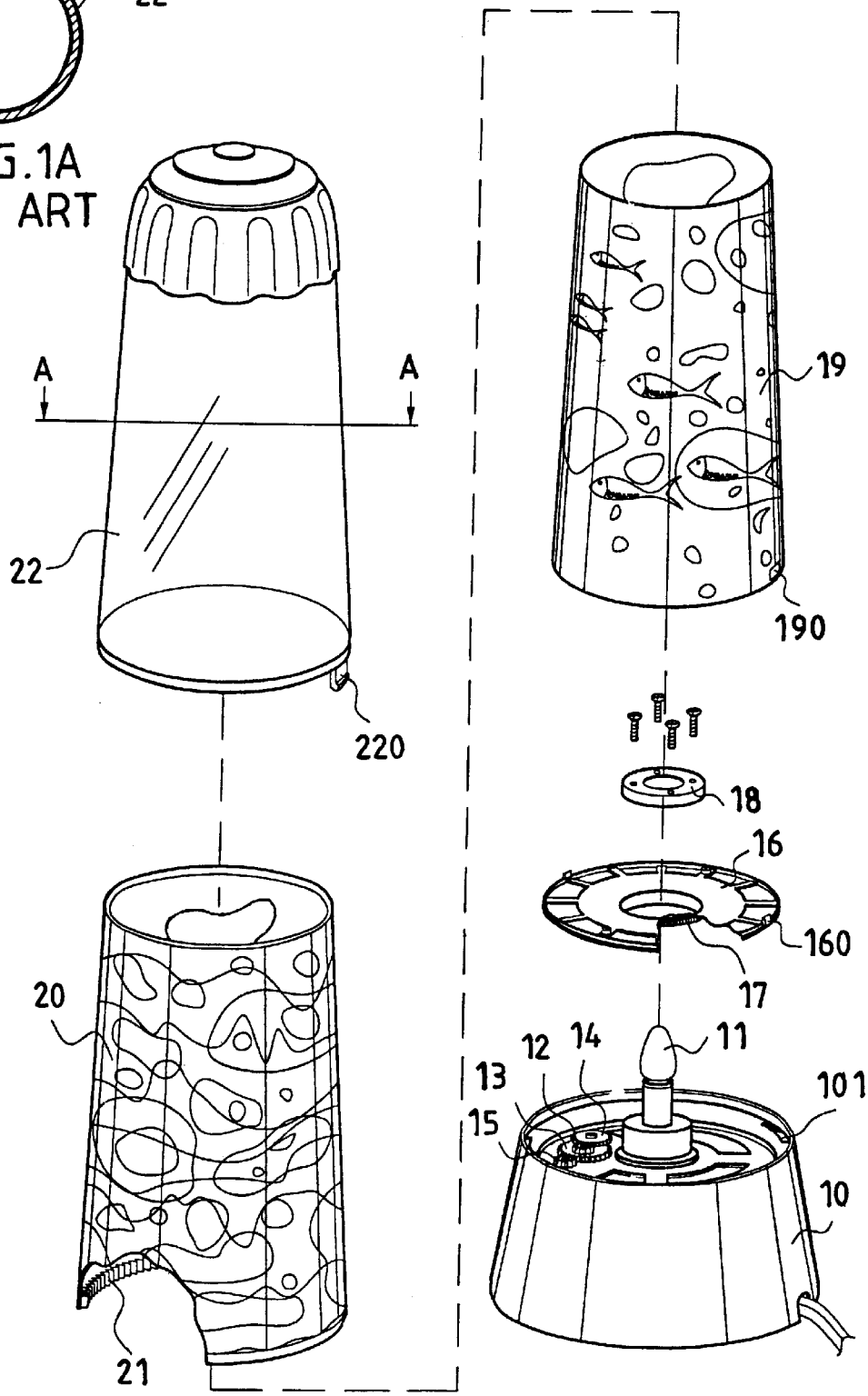
FIG.1 PRIOR ART
FIG. 1 is an exploded view of an aquarium-simulating lamp according to the prior art.
Figure 2:
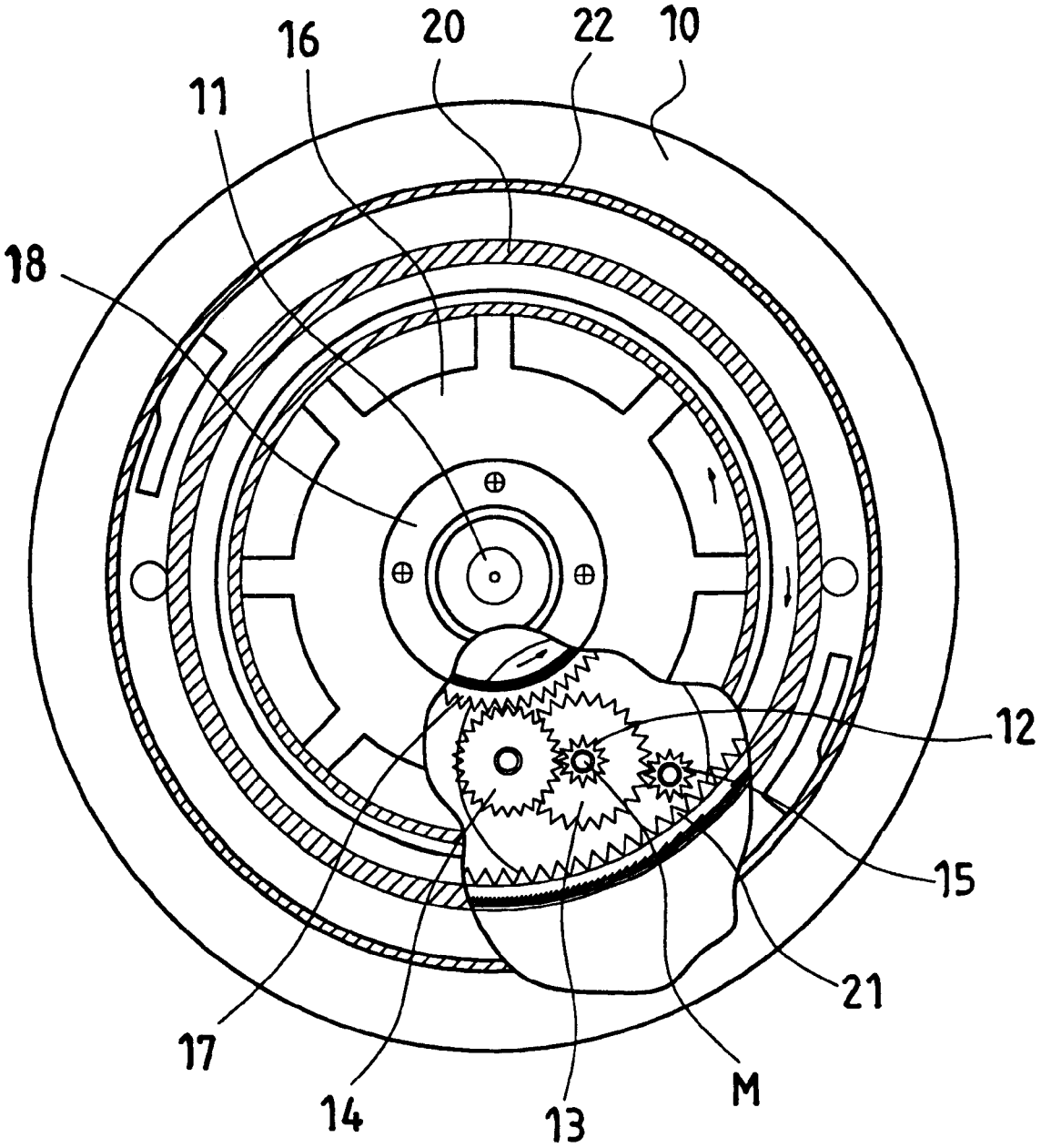
FIG.2 PRIOR ART
FIG. 2 is a sectional top view of the prior art aquarium-simulating lamp.
Figures 3, 3A:
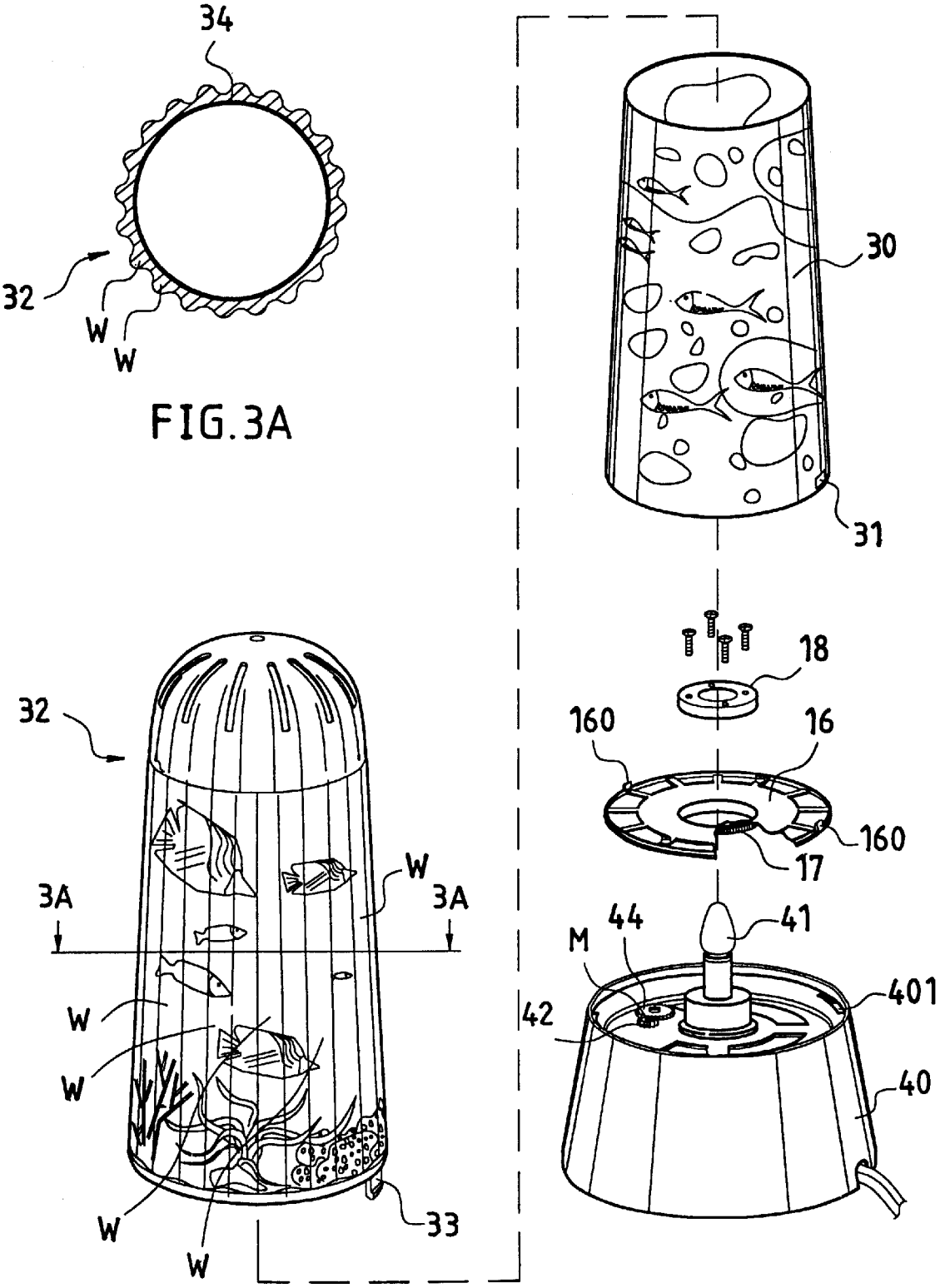
FIG. 3 is an exploded view of a decorative lamp according to the present invention.
FIG. 3A is a sectional view taken along line A—A of FIG. 3.
Figure 4:
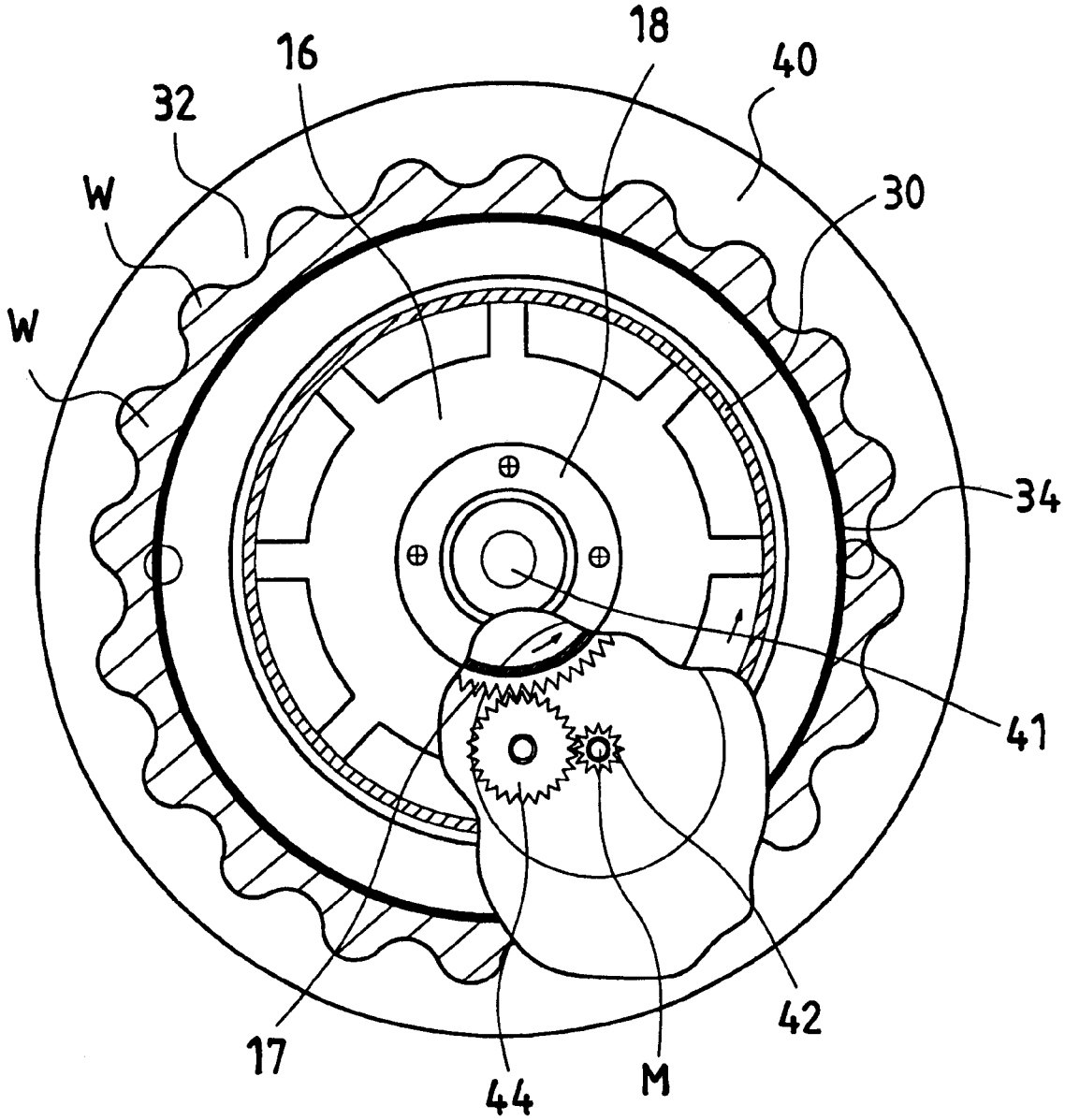
FIG. 4 is a sectional top view of the decorative lamp according to the present invention.

Referring to FIGS. 3 and 4, a decorative lamp in accordance with the present invention is shown comprising a base 40, a rotary table 16, an inner lampshade 30, and a magnifying outer lampshade 32. The base 40 comprises a top coupling groove 401. A lamp bulb 41 is provided at the top side of the base 40. A motor is mounted in the base 40 with the output shaft M extended out of the top sidewall of the base 40. A pinion 42 is fixedly mounted on the output shaft M of the motor. A transmission gear 44 is supported on the top sidewall of the base 40 and meshed with the pinion 42. The rotary table 16 is revolvably mounted on the top sidewall of the base 40 with a locating ring 18, having a plurality of top hooks 160, and a fixed bottom gear 17 meshed with the transmission gear 44. The inner lampshade 30 admits light and is fixedly mounted on the rotary table 16 for synchronous rotation with the rotary table 16, having a design of underwater scene on the outside wall thereof and a bottom coupling groove 31 hooked up with the top hooks 160 of the rotary table 16. The magnifying outer lampshade 32 is a transparent lampshade of magnifying glass fixedly mounted on the base 40 over the inner lampshade 30 to magnify the apparent dimensions of the inner lampshade 30, having a design of underwater scene on the inside wall thereof and a plurality of bottom hooks 33 respectively hooked in the top coupling groove 401 of the base 40. The outside wall of the magnifying outer lampshade 32 is not a smooth wall. As illustrated in FIG. 3A, the magnifying outer lampshade 32 has a plurality of ribs W on the outside wall 34, producing a convex lens effect to magnify the apparent dimensions of the inner lampshade 30.

Referring to FIG. 4 again, when electrically connected, the lamp bulb 41 is turned on to emit light through the inner lampshade 30 and the magnifying outer lampshade 32, and at the same time the pinion 42 is driven by the output shaft M of the motor to rotate the transmission gear 44 and then the bottom gear 17 of the rotary table 16, thereby causing the inner lampshade 30 to be rotated with the rotary table 16 on the base 40 inside the magnifying outer lampshade 32, producing a motion visual effect. Because the inner lampshade 30 is rotated inside the magnifying outer lampshade 32, the design of underwater scene of the inner lampshade 30 and the design of underwater scene of the magnifying outer lampshade 32 are turned relative to each other in reversed direction, simulating the visual effect of an aquarium.

A prototype of decorative lamp has been constructed with the features of FIGS. 3 and 4. The decorative lamp functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A decorative lamp comprising:

a base having a chamber formed therein;

a motor drive unit received within said chamber of said base;

a rotary table mounted on, and rotationally driven by, said motor drive unit;

a lamp bulb mounted on said base;

an inner lamp shade mounted on said rotary table and covering said lamp bulb, said inner lamp shade having indicia simulating an underwater environment printed thereon; and, a transparent outer lamp shade having an outer surface removably mounted on said base and an inner surface having indicia simulating an underwater environment printed thereon said outer surface having an undulating contour, said undulating contour forming a plurality of peaks and a plurality of troughs, a distance between adjacent ones of said peaks being substantially equal to a distance between adjacent ones of said troughs said undulating contour defining a convex lens means for magnifying said indicia on said inner and outer lamp shade.

* * * * *